US008611570B2

(12) United States Patent
Neumeyer et al.

(10) Patent No.: US 8,611,570 B2
(45) Date of Patent: Dec. 17, 2013

(54) DATA STORAGE SYSTEM, HEARING AID, AND METHOD OF SELECTIVELY APPLYING SOUND FILTERS

(75) Inventors: Frederick Charles Neumeyer, Austin, TX (US); John Gray Bartkowiak, Orkney (GB); David Matthew Landry, Austin, TX (US); Samir Ibarhim, Silver Spring, MD (US); John Michael Page Knox, Austin, TX (US); Andrew L. Eisenberg, Austin, TX (US)

(73) Assignee: Audiotoniq, Inc., Austin, TX (US)

( * ) Notice: Subject to any disclaimer, the term of this patent is extended or adjusted under 35 U.S.C. 154(b) by 190 days.

(21) Appl. No.: 13/108,701

(22) Filed: May 16, 2011

(65) Prior Publication Data

US 2011/0293123 A1 Dec. 1, 2011

Related U.S. Application Data

(60) Provisional application No. 61/348,166, filed on May 25, 2010, provisional application No. 61/362,203, filed on Jul. 7, 2010, provisional application No. 61/362,199, filed on Jul. 7, 2010.

(51) Int. Cl.
*H04R 25/00* (2006.01)

(52) U.S. Cl.
USPC ..... 381/314; 381/312

(58) Field of Classification Search
USPC ..... 381/60, 312, 314–318, 320–321
See application file for complete search history.

(56) References Cited

U.S. PATENT DOCUMENTS

| | | | | |
|---|---|---|---|---|
| 4,025,721 | A | 5/1977 | Graupe et al. | |
| 4,658,426 | A | 4/1987 | Chabries et al. | |
| 5,475,759 | A | 12/1995 | Engebretson | |
| 5,604,812 | A | 2/1997 | Meyer | |
| 5,721,783 | A | 2/1998 | Anderson | |
| 5,852,668 | A * | 12/1998 | Ishige et al. | 381/312 |
| 6,574,340 | B1 * | 6/2003 | Bindner et al. | 381/60 |
| 6,910,013 | B2 | 6/2005 | Allegro et al. | |
| 7,158,569 | B1 | 1/2007 | Penner | |
| 7,343,023 | B2 | 3/2008 | Nordqvist et al. | |
| 7,590,250 | B2 | 9/2009 | Ellis et al. | |
| 7,738,665 | B2 | 6/2010 | Dijkstra et al. | |
| 7,853,028 | B2 | 12/2010 | Fischer | |
| 2003/0223605 | A1 | 12/2003 | Blumenau | |
| 2004/0066944 | A1 | 4/2004 | Leenen et al. | |
| 2007/0041589 | A1 | 2/2007 | Patel et al. | |
| 2009/0306937 | A1 | 12/2009 | Chen | |

* cited by examiner

*Primary Examiner* — Suhan Ni
(74) *Attorney, Agent, or Firm* — Lee & Hayes, PLLC

(57) ABSTRACT

A data storage system includes a network interface configurable to couple to a network for receiving data related to an acoustic environment from a device and a memory for storing a plurality of environmental filters. The data storage system further includes a processor coupled to the memory and the network interface, the processor configurable to analyze the data and selectively provide one or more of the plurality of environmental filters to the device based on the analysis of the data.

5 Claims, 8 Drawing Sheets

DATA STORAGE SYSTEM, HEARING AID, AND METHOD OF SELECTIVELY APPLYING SOUND FILTERS

CROSS-REFERENCE TO RELATED APPLICATION(S)

This application is a non-provisional of and claims priority to U.S. Provisional Patent Application No. 61/348,166 filed on May 25, 2010 and entitled "System for providing Environment-Based Sound Filters," which is incorporated herein by reference in its entirety. Additionally, this application is a non-provisional of and claims priority to U.S. Provisional Patent Application No. 61/362,199, filed on Jul. 7, 2010 and entitled "System of Applying Location-Based Adjustments to a Hearing Aid," which is incorporated herein by reference in its entirety. Further, this application is a non-provisional of and claims priority to U.S. Provisional Patent Application No. 61/362,203, filed on Jul. 7, 2010 and entitled "Location-Based Hearing Aid Profile Selection System," which is incorporated herein by reference in its entirety.

FIELD

This disclosure relates generally to hearing aids, and more particularly to systems, hearing aids, and methods of providing environment-based sound filters.

BACKGROUND

Hearing deficiencies can range from partial hearing impairment to complete hearing loss. Often, an individual's hearing ability varies across the range of audible sound frequencies, and many individuals have hearing impairment with respect to only select acoustic frequencies. For example, an individual's hearing loss may be greater at higher frequencies than at lower frequencies.

Hearing aids are electronic devices worn on or within the user's ear and configured by a hearing health professional to modulate sounds to produce an audio output signal that compensates for the user's hearing loss. The hearing health professional typically takes measurements using calibrated and specialized equipment to assess the individual's hearing capabilities in a variety of sound environments, and then adjusts (configures) the hearing aid based on the calibrated measurements. Subsequent adjustments to the hearing aid can require a second assessment of the user's hearing and further calibration by the hearing health professional, which can be costly and time intensive. In some instances, the hearing health professional may create multiple hearing profiles for the user for execution by the hearing aid in different sound environments.

However, merely providing stored hearing profiles may leave the user with a subpar hearing experience because each acoustic environment may vary in some way from the stored hearing aid profiles provided by the hearing health professional. Storing more profiles on the hearing aid provides for better potential coverage of various listening environments but requires a larger memory and increased processing capabilities in the hearing aid. Increased memory and enhanced processing increase the size requirements of the hearing aid that users prefer to be small and unobtrusive.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Currently, hearing aids provide only localized, user-specific hearing correction and typically the correction is generalized for a large number of acoustic environments. However, such generalization of acoustic environments fails to account for the wide variety of acoustic environments that the user may experience. Embodiments of systems and methods are disclosed below that provide an environment-based sound profiling system, which collects, analyzes, and uses environmental sounds from various sources and from different locations to produce environment-based sound profiles. Such environment-based sound profiles can be used to produce sound filters that can be applied to a selected hearing aid profile or modulated output signals of the user's hearing aids, as well as to other hearing aids, allowing individual hearing aid users to benefit from the experiences of others. Thus, instead of selecting hearing correction parameters derived for one environment that can be applied to other, nominally similar, environments, the system can produce sound profiles specific to a location and produce corresponding sound filters for that location.

Such sound filters can be applied to the user's selected hearing aid profile (or to the modulated output generated by applying the selected hearing aid profile to sounds) to modify the output signal to adjust for the user's hearing impairment while filtering at least a portion of the output signal to dampen, reduce or otherwise alter at least a portion of the environmental noise. For example, an environment-based sound profile can be created for a construction site or an airport, which profile can be used to create an associated sound filter for filtering the associated sounds. The sound filter may be provided to the hearing aid of the user and/or to other hearing aids of other users in the same vicinity. The hearing aid can modify its selected hearing aid profile and/or filter the sound signal either before or after application of the selected hearing aid profile to filter the environmental sounds to enhance the user's hearing aid experience.

A location based hearing aid profile selection system allows the user to customize and pre-set their hearing aid profile selections for commonly visited physical locations. For example, the user may define physical locations, such as the home or work, and associate their hearing aid profiles to such defined physical locations. By utilizing a location indicator, or global positioning system, the hearing aid profile can be updated automatically to fit the user's environment based on determined location data, without requiring hearing aid profile selection by the user. In one possible example, the user can configure the profile selection system once for commonly visited physical locations, and the hearing aid can apply the appropriate hearing aid profile based on user's location without the user haying to hassle with manual selection the hearing aid profile.

Figure 1:
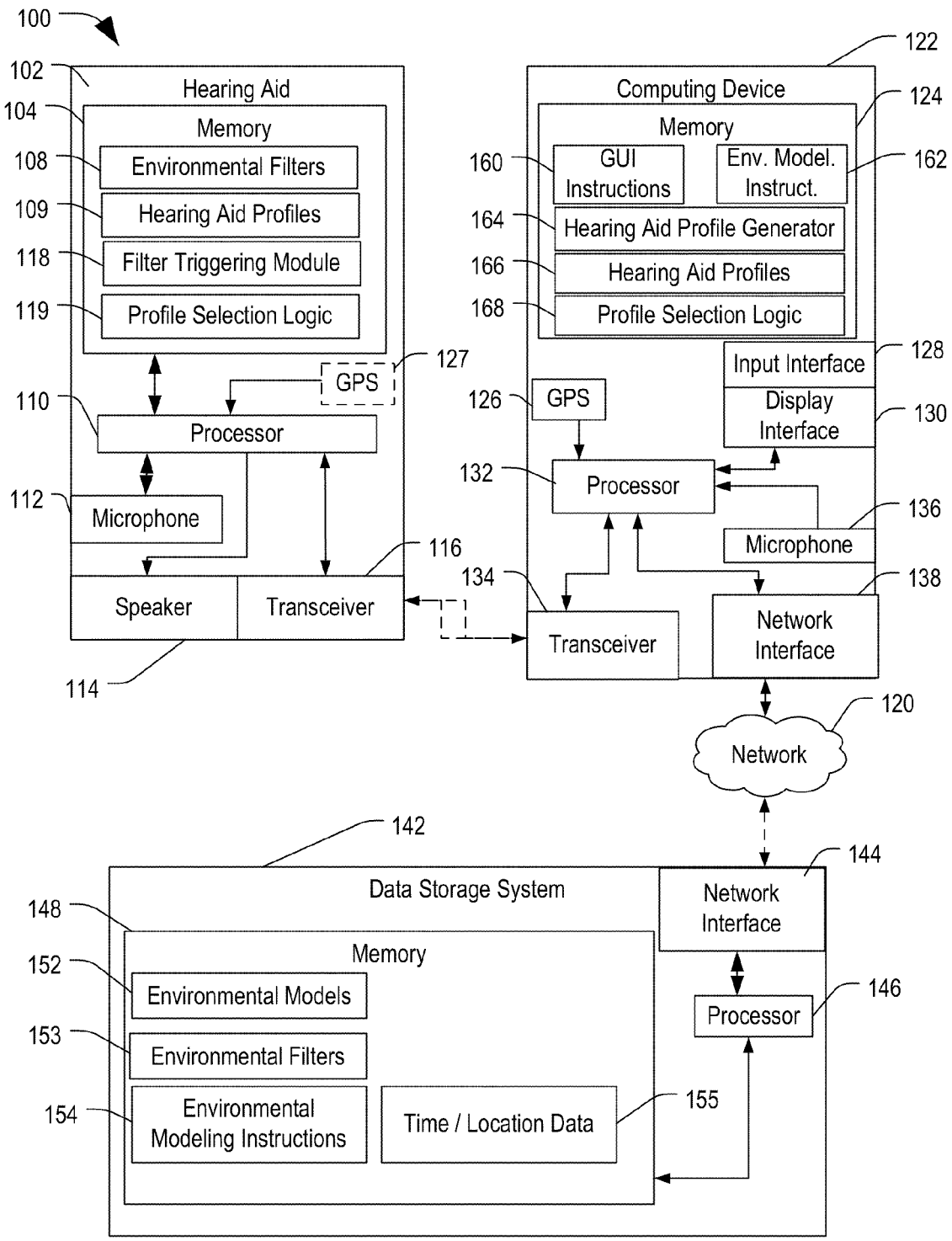
FIG. 1 is a block diagram of an embodiment of a hearing aid system adapted to send and receive acoustic data.

As used herein, the term "hearing aid profile" refers to a collection of acoustic configuration settings for a hearing aid, such as hearing aid 102 of FIG. 1, which are designed to be executed by a processor within the hearing aid to modulate audio signals from the microphone to produce a modulated output signal to compensate for the particular user's hearing loss. The collection of acoustic configuration settings can include one or more sound shaping algorithms and associated coefficients for shaping sounds into modulated sound signals for reproduction by a hearing aid for the particular user. Each hearing aid profile, further, includes one or more parameters to shape or otherwise adjust sound signals for a particular acoustic environment. Such sound shaping algorithms, coefficients, and parameters can include signal amplitude and gain characteristics, signal processing algorithms, frequency response characteristics, coefficients associated with one or more signal processing algorithms, or any combination thereof.

As used herein, the term "location" or "geographical area" refers to a physical area (which may be defined by a user or programmatically defined) that can be associated with a hearing aid profile, such that the hearing aid will apply the associated hearing aid profile to shape sound for the user when the user is within the physical area. The location or geographical area may be defined based on a geographical map or may be associated with a range of coordinates, such as GPS coordinates.

FIG. 1 is a block diagram an embodiment of a hearing aid system 100 adapted to send and receive acoustic data. Hearing aid system 100 includes a hearing aid 102 adapted to communicate with a computing device 122 and includes a data storage system 142 adapted to communicate with computing device 122, for example, through a network 120.

Hearing aid 102 includes a processor 110 connected to a memory 104. Memory 104 stores processor-executable instructions, such as environmental filters 108, one or more hearing aid profiles 109, a filter triggering module 118, and profile selection logic 119. Each of the hearing aid profiles 109 is based on the user's hearing characteristics and processor 110 can apply a selected hearing aid profile to shape a signal to produce a shaped output signal that compensates for the user's hearing loss. Further, processor 110 can apply a selected sound filter associated with a particular acoustic environment to provide a filtered output signal. Profile selection logic 119 is executable by processor 110 to select one of the one or more hearing aid profiles 109 for processing audio signals. Further, in response to filter triggering module 118, processor 110 can selectively apply one or more environmental filters to the selected hearing aid profile 109 and/or to the modulated audio signal to filter the audio output for the particular environment.

Hearing aid 102 further includes a microphone 112 connected to processor 110 and adapted to receive environmental noise or sounds and to convert the sounds into electrical signals. Microphone 112 provides the electrical signals to processor 110, which processes the electrical signals according to a currently selected hearing aid profile to produce a shaped output signal that is provided to a speaker 114, which is configured to reproduce the modulated output signal as an audible sound. When an environmental filter 108 is applied, processor 110 may apply the environmental filter 108 to the sound signal before or after applying the hearing aid profile 109 or may applying the environmental filter 108 to modify the hearing aid profile 109 and use the modified hearing aid profile 109 to modulate the sound signal.

Hearing aid 102 includes a transceiver 116 connected to processor 110 and configured to communicate with computing device 122 through a communication channel. In an embodiment, transceiver 116 is a radio frequency transceiver configured to send and receive radio frequency signals, such as short range wireless signals, including Bluetooth® protocol signals, IEEE 802.11 family protocol signals, or other standard or proprietary wireless protocol signals. Optionally, hearing aid 102 may also include location-sensing circuitry, such as a global positioning satellite (GPS) circuit 127, connected to processor 110 for providing location and/or time information.

Computing device 122 is any device having a processor capable of executing instructions, including a personal digital assistant (PDA), smart phone, portable computer, or mobile communication device. Computing device 122 is adapted to send and receive radio frequency signals according to any protocol compatible with hearing aid 102. One representative embodiment of computing device 122 is the Apple iPhone®, which is commercially available from Apple, Inc. of Cupertino, Calif. Another representative embodiment of computing device 122 is the Blackberry® phone, available from Research In Motion Limited of Waterloo, Ontario. Other types of mobile computing devices can also be used.

Computing device 122 includes a memory 124, which is accessible by a processor 132. Processor 132 is connected to a transceiver 134, and optionally a microphone 136. Processor 132 is also connected to a display interface 130, which can display information to a user, and to an input interface 128, which is configured to receive user input. In some embodiments, a touch screen display may be used, in which case display interface 130 and input interface 128 can be combined. Computing device 122 further includes location-sensing circuitry, such as a GPS circuit 126 configured to detect a location of computing device 122, within a margin of error, and to provide location data to processor 132.

Transceiver 134 is configured to communicate with hearing aid 102 through the communication channel. In an example, transceiver 134 can be a radio frequency transceiver configured to send and receive radio frequency signals, such as short range wireless signals, including Bluetooth® protocol signals, IEEE 802.11 family protocol signals, or other standard or proprietary wireless protocol signals. In some instances, the communication channel can be a Bluetooth® communication channel.

Memory 124 stores a plurality of instructions that are executable by processor 132, including graphical user interface (GUI) generator instructions 160, environmental modeling instructions 162, and hearing aid profile generator instructions 164. When executed by processor 132, GUI generator instructions 162 cause processor 132 to produce a GUI for display to the user via the display interface 130, which may be a liquid crystal display (LCD) or other display device or which may be coupled to a display device. Memory 124 may also include a plurality of hearing aid profiles 166 associated with the user.

Computing device 122 further includes a network interface 138 configured to communicate with data storage system 142 through a network 120, such as a Public Switched Telephone Network (PSTN), a cellular and/or digital phone network, the Internet, another type of network, or any combination thereof. Network interface 138 makes it possible for various parameters associated with acoustic environments to be communicated between computing device 122 and data storage system 142.

Data storage system 142 collects and analyzes acoustic data. Data storage system 142 includes a processor 146 connected to a network interface 144 that is communicatively coupled to network 120, and is connected to a memory 148, which stores environmental modeling instructions 154, a plurality of environmental models 152, and a plurality of environmental filters 153. In some instances, memory 148 may also store data from one or more remote devices, such as computing device 122.

As used herein, the term "environmental model" refers to a set of parameters, acoustic data, location data, and time data that can be used to characterize a particular acoustic location or environment. In a particular example, the environmental model includes a snapshot of acoustic frequencies and amplitudes for a particular location at a particular time of day, which snapshot can be used to derive one or more environmental filters 153. The environmental models 152 may be used by data storage system 142 for comparison to data received from computing device 122 to identify one or more environmental filters that may be desirable for the user's current location. As used herein, the term "environmental filter" refers to a collection of settings applicable to specific acoustic environment. Each environmental filter 153 represents a group of settings designed to improve the hearing experience of a majority of users when applied by their hearing aids. Each of the environmental filters 153 includes a set of parameters or adjustments, which can be applied to a hearing aid profile to adjust the shaped output, to filter or otherwise attenuate environmental noise, to dampen the sound-shaping provided by the hearing aid profile 109 being applied by the hearing aid 102, and/or to modify the hearing aid profile. In a particular example, each of the environmental filters 153 includes one or more parameters such as filter bandwidths, filter coefficients, compression attack and release time constants, amplitude thresholds, compression ratios, hard and soft knee thresholds, volume settings, adaptive filter step size and feedback constants, adjustable gain control settings, noise cancellation, and optionally other parameters. Environmental filters 153 may be generated by processor 146 executing environmental modeling instructions 154, which cause processor 146 to analyze environmental data and apply an algorithm or set of algorithms to the environmental data to produce an environmental filter, which may be stored as one of environmental filters 153. Environmental filters 153 may also be generated remotely by a hearing health professional and stored in memory 148.

In a particular example, environmental modeling instructions 154 analyze the data to identify one or more frequencies having amplitudes that exceed a threshold level, and generate an environmental filter 153 to attenuate the amplitude at such frequencies. Further, environmental modeling instructions 154 can be used to identify frequencies where the amplitude is relatively constant over time, which constant noise may be indicative of, for example, construction noise, traffic, or other types of constant background noise. In this instance, environmental modeling instructions 154 can generate an environmental filter 153 to attenuate the identified noise.

In an example, hearing aid 102 and/or computing device 122 captures a sample of the acoustic environment. Hearing aid 102 may provide the sample to computing device 122. Computing device 122 generates a data package, including data related to the sample of the acoustic environment, location data, and/or time data, and provides the data package to data storage system 142. As data storage system 142 receives the data, processor 146 executes environmental modeling instructions 154 to analyze the data to generate an environmental model 152. In some instances, such as where samples of the acoustic environment are received from multiple sources, processor 146 uses environmental modeling instructions 154 to analyze, compare, and associate the data from the different sources to generate and/or modify the environmental model 152. Each environmental model represents a particular acoustic environment (i.e., sound characteristics of a physical location at a particular time of day). Processor 146 generates at least one environmental filter 153 applicable to particular acoustic nuances of each environmental model.

Such environmental filters 153 may alter one or more settings of a hearing aid profile 109 of a hearing aid 102 to attenuate or otherwise alter sound signals at certain frequencies corresponding to frequencies within the acoustic environment. In an example, each environmental filter 153 is designed to pass some frequency regions through unattenuated while significantly attenuating others. The environmental filter 153 be low-pass (passing through frequencies below a cutoff frequency and progressively attenuating higher frequencies), high-pass (passing through high frequencies above a cutoff frequency, and attenuating or completely blocking frequencies below the cutoff frequency), or bandpass (permitting only a range of frequencies to pass, while attenuating or completely blocking those outside the range). In some embodiments, the environmental filter may include, for example, a combination of a low-pass or a high-pass filter and a band-reject filter, which attenuates a band of frequencies within a frequency range while allowing other frequencies to pass unchanged. This type of filter can attenuate undesired noise at certain frequencies while allowing other frequencies to pass. In a particular example, a band-reject filter may attenuate a contiguous range of frequencies, or have maximum attenuation at one frequency (the "notch" frequency) while passing all others, having progressively less effect harmonics of the one frequency.

In a particular instance, the environmental filter 153 can be applied by processor 110 to a selected hearing aid profile 109 to attenuate selected frequencies. In this example, processor 110 can adjust coefficients of the selected hearing aid profile 109 to provide the desired attenuation. In one instance, the environmental filter 153 is applied to the audio signal before or after application of the hearing aid profile 109.

Such filters 153 may be provided to different hearing aids and applied by such hearing aids to different hearing aid profiles (which are customized to the particular users) to produce altered hearing aid profiles that are customized to a particular acoustic condition or environment.

In some instances, the environmental filters 153 may be associated with specific locations at specific times. For example, one particular environmental model of environmental models 152 may represent a construction zone with significant noise, which hearing aid users may want to filter out. In this example, processor 146 uses the environmental model to apply environmental modeling instructions 154 to produce an environmental filter, which can be applied to dampen the amplitude of the frequencies associated with the construction noise or to filter out at least some of the construction noise. Further, it should be understood that the particular construction zone of the example may have multiple environmental models associated with it such as an environmental model to represent the construction zone during certain hours of the day (e.g., coincident with periods of intense activity) and another to represent the construction zone during certain hours of the night (e.g., coincident with periods of relative calm). Each of the environmental models would have its own associated environmental filters to provide a desired filtering effect for the acoustic environment as it changes over time. Additionally, while some construction zones may contain similar acoustic characteristics and therefore the same environmental model and environmental filters could apply, it is possible that each construction zone may have its own particular environmental model (e.g., a high-rise office building construction site as compared to a residential wood-frame home construction site). Thus, environmental models may be created for a variety of locations and for various times of day.

It should be appreciated that the same location may have different acoustic profiles, depending on the time of day, in terms of acoustic frequencies, amplitude, and other acoustic characteristics. For example, a busy street during rush hour may be quite different from the same street after dinner time. In some instances, two different locations may have very similar profiles. For example, the profile of the aforementioned busy street could be very similar to another busy street during the day. Further, a location such as a skyscraper may have different sound characteristics at different elevations. Accordingly, the environmental model may have multiple dimensions and may be time-varying.

In an example, a trigger initiates the sound profiling system. The trigger could be generated by the user's input at input interface 128 on computing device 122, by hearing aid 102 in response to a change in the audio output level, or by other sources. For example, processor 132 may generate the trigger in response to a sound sample taken by either microphone 112 or 136 in hearing aid 102 or computing device 122, respectively, which sound sample is indicative that the current hearing aid profile may be unsuitable for the current acoustic environment or that a sound threshold has been exceeded. Alternatively, the trigger could be generated by processor 132 based on a change in location collected by GPS 126 or by a user request.

In an embodiment, the trigger is received by processor 132 in computing device 122. The trigger causes processor 132 to generate a data package to send to data storage system 142 including a request for an environmental filters. Processor 132 may provide the data package to data storage system 142 contained a variety of information.

In one embodiment, processor 132 initiates an acoustic data or sound sample collection process. In one instance, processor 132 causes transceiver 134 to send a trigger to hearing aid 102 to cause hearing aid 102 to capture sound samples and send them to computing device 122. Alternatively, processor 132 instructs microphone 136 to sample the user's current environment and convert the sound into electrical signals for processor 132. Processor packages the acoustic data into a data package for transmission to data storage system 142. The data package may include the sound sample, data derived from the sound sample, location data, time data, or a combination thereof. For example, the data package may include acoustic environment information such as frequencies, decibel levels or amplitudes at each frequency, day/time data associated with capturing of the sample, and location data associated with the physical location where the sound sample was collected (based on the GPS 126). In one example, the data package can include data related to the hearing aid profile of the user's hearing aid 102. In a second example, the data package includes a location indicator, such as a GPS position from GPS 126. In some instances, processor 132 encrypts the data to protect the individual's privacy. Once the acoustic environment data is collected and compiled as a data package, processor 132 provides the encoded data to network interface 138 for communication to data storage system 142.

In another alternative embodiment, the trigger may be received by processor 110 in hearing aid 102 instead of by processor 132 in computing device 122. In this instance, processor 110 instructs microphone 112 to sample the environment. Processor 110 then processes the sound sample to generate the data package and/or provides the sound sample to computing device 122. Alternatively, in response to receiving the trigger, processor 110 sends a command to computing device 122, instructing processor 132 to collect the sound sample using microphone 136.

In yet another alternative embodiment, neither hearing aid 102 nor computing device 122 samples the acoustic environmental. In this embodiment, the user may select an environment from a list of environments within a GUI reproduced on display interface 130 by interacting with input interface 128 to input a selection. The GUI can include a list of environments, each of which may be associated with an environmental model or with various acoustic environmental parameters that would otherwise be obtained during the sampling process. The data package may include a sound sample, data derived from the sound sample, and/or a user selection and optionally location data. Computing device 122 communicates the data package to data storage system 142. Data storage system 142 processes the data package and selects a suitable environmental filter.

In a first example, data storage system 142 selects an environmental model 152 based on the data package. In one instance, data storage system 142 checks whether an environmental model 152 already exists for the particular location associated with the data package. In one particular example, the environmental model may simply consist of a set of three-dimensional GPS coordinates including longitude data, latitude data, and/or elevation data. In a second particular example, the environmental model may additionally include a time coordinate. If data storage system 142 finds an environmental model corresponding to the locational data, data storage system 142 returns an environmental filter 153 associated with the model to computing device 122.

In a second example, data storage system 142 selects the environmental model based on the data package. In this example, the environmental model 152 includes acoustic parameters associated with particular sounds or acoustic characteristics, such that processor 146 is able to compare and analyze the acoustic environmental data with the parameters associated with the environmental models 152 to select a suitable match. Once identified, processor 146 retrieves an associated environmental filter 153 and provides the associated environmental filter 153 to computing device 122, which provides the filter to hearing aid 102.

In a third example, data storage system 142 selects the environmental model 152 corresponding to acoustic characteristics of the data package. In this example, data storage system 142 returns the environmental filter 153 associated with the identified environmental model.

In should be understood that, data storage system 142 may select the environmental model using a combination of the examples above. In another example, data storage system 142 can generate an environmental filter based on the selected environmental model, associated environmental filters, and the user's personal data, such as a hearing aid profile, if it is included in the data package.

If data storage system 142 cannot identify at least one environmental model for the particular location based on the data package provided, data storage system 142 may attempt to identify a close match based on a comparison between the data contained in the data package and data stored in memory 148. Alternatively, data storage system 142 may generate a new environmental module using environmental modeling instructions 154. In this instance, data storage system 142 is also configured to store data from the data package in memory 148, and to execute environmental modeling instructions 154 to refine the environmental filters and environmental models based on the data contained in each data package. Environmental modeling instructions 154, when executed, may cause processor 146 to generate new environmental filters or environmental models. Any newly generated environmental filter can be stored in memory 148 and associated with at least one environmental model.

Once the suitable environmental model is selected, processor 146 transmits the associated environmental filter to computing device 122 and/or hearing aid 102. In one instance, computing device 122 applies the filters to at least one hearing aid profile to generate a new hearing aid profile for the sampled acoustic environment. After the new hearing aid profile is generated, processor 110 in hearing aid 102 applies the new hearing aid profile 109 to sound signals received from microphone 112 to generate the shaped output signal. The shaped output signal including the corrections determined from the environmental model and the corrections provided by the original hearing aid profile.

In another instance, computing device 122 provides the filter to hearing aid 102. In one embodiment, hearing aid 102 applies the filter to the selected hearing aid profile 109 to modify the hearing aid profile 109 to provide a modulated output signal that is filtered for the particular environment. In another embodiment, hearing aid 102 applies the filter before or after application of the selected hearing aid profile 109 to provide a filtered, modulated output signal. In still another example, the filter and the selected hearing aid profile 109 are applied substantially concurrently to produce the filtered, modulated output signal.

Further, processor 132 may execute GUI instructions 160 to present a graphical interface including a map, text, images, or any combination thereof for display on display interface 130 and may receive user inputs related to the graphical interface from input interface 128. In a particular example, a user can interact with the graphical interface to associate a particular hearing aid profile 166 with a particular geographical location. An example of such a user interface is described below with respect to FIG. 8. Further, once defined, processor 132 can provide such location information to hearing aid 102, and processor 110 execute profile selection logic 119 in conjunction with location data (such as location data provided by computing device 122 based on GPS circuit 126 or location data from GPS circuit 127) to select one of the hearing aid profiles 109 that is associated with the particular location.

Figure 2:
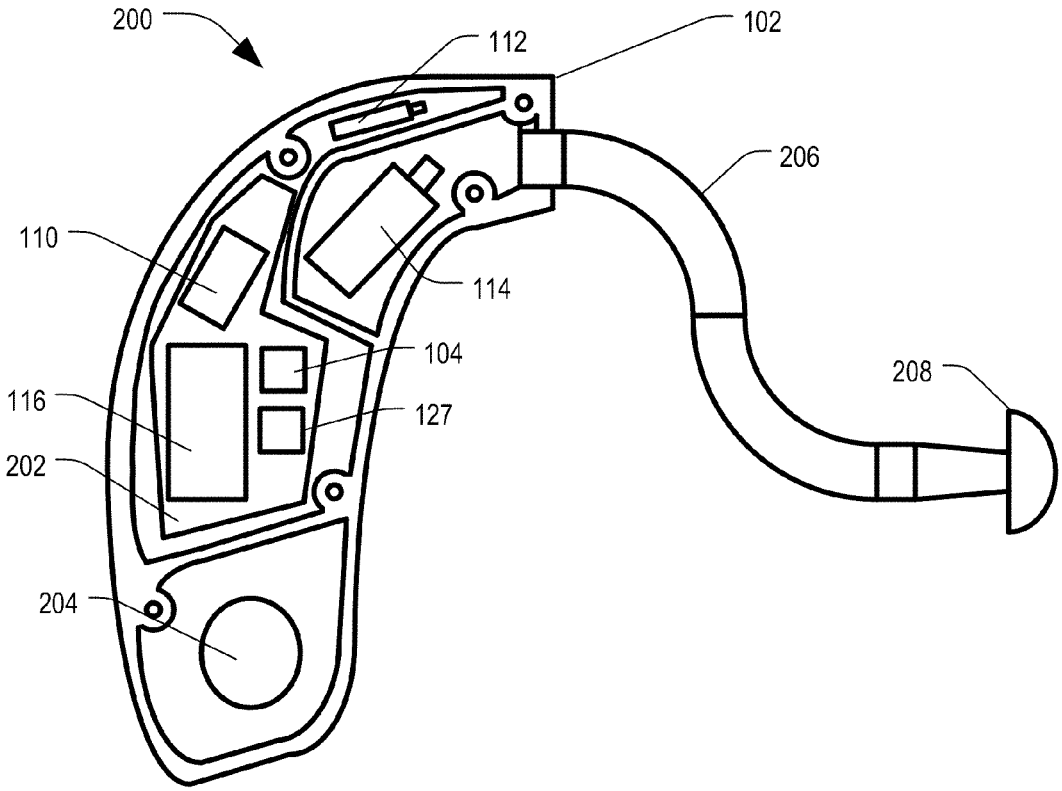
FIG. 2 is a cross-sectional view of a representative embodiment of an external hearing aid including logic to send and receive acoustic data.

FIG. 1 shows a representative example of one possible embodiment of a sound profiling system for providing environment-based sound filters that uses the computing device 122 to communicate data between hearing aid 102 and data storage system 142. However, in some embodiments, a network transceiver may be incorporated in hearing aid 102 to allow hearing aid 102 to communicate with data storage system 142, bypassing computing device 122. In such a case, computing device 122 may be omitted. Further, it should be appreciated that hearing aid 102 may take any number of forms, including an over-the-ear or in-the-ear design. FIG. 2 shows one possible representative behind-the-ear hearing aid that is compatible with the system of FIG. 1.

FIG. 2 is a cross-sectional view of a representative embodiment 200 of an external hearing aid, which is one possible embodiment of hearing aid 102 in FIG. 1, including logic to send and receive environment-based acoustic data. Hearing aid 200 includes a microphone 112 to convert sounds into electrical signals. Microphone 112 is connected to circuit 202, which includes at least one processor 110, transceiver device 116, and memory 104. Further, hearing aid 200 includes a speaker 114 connected to processor 110 and configured to communicate audio data through ear canal tube 206 to an ear piece 208, which may be positioned within the ear canal of a user. Further, hearing aid 200 includes a battery 204 to supply power to the other components. In one example, speaker 114 can be located in ear piece 208, and ear canal tube 206 can be a wire for connecting the speaker 114 to circuit 202.

In an example, microphone 112 converts sounds into electrical signals and provides the electrical signals to processor 110, which processes the electrical signals according to a hearing aid profile associated with the user to produce a modulated output signal that is customized to a user's particular hearing ability. The modulated output signal is provided to speaker 114, which reproduces the modulated output signal as an audio signal and which provides the audio signal to ear piece 206 through canal tube 208.

In some instances, hearing aid 102 applies an environmental filter to a selected hearing aid profile 109 to produce an adjusted hearing aid profile, which can be used to modulate sound signals to produce a modulated output signal that is compensated for the user's hearing deficiency and filtered to adjust environmental noise. In other instances, hearing aid 102 applies the environmental filter before or after application of the selected hearing aid profile 109 to produce the compensated and filtered output signal.

While hearing aid 200 illustrates an external "wrap-around" hearing device, the user-configurable processor 110 can be incorporated in other types of hearing aids, including hearing aids designed to be worn behind the ear or within the ear canal, or hearing aids designed for implantation. The embodiment of hearing aid 200 depicted in FIG. 2 represents only one of many possible implementations of a hearing aid with transmitter in which the sound profiling system can be used.

Figure 3:
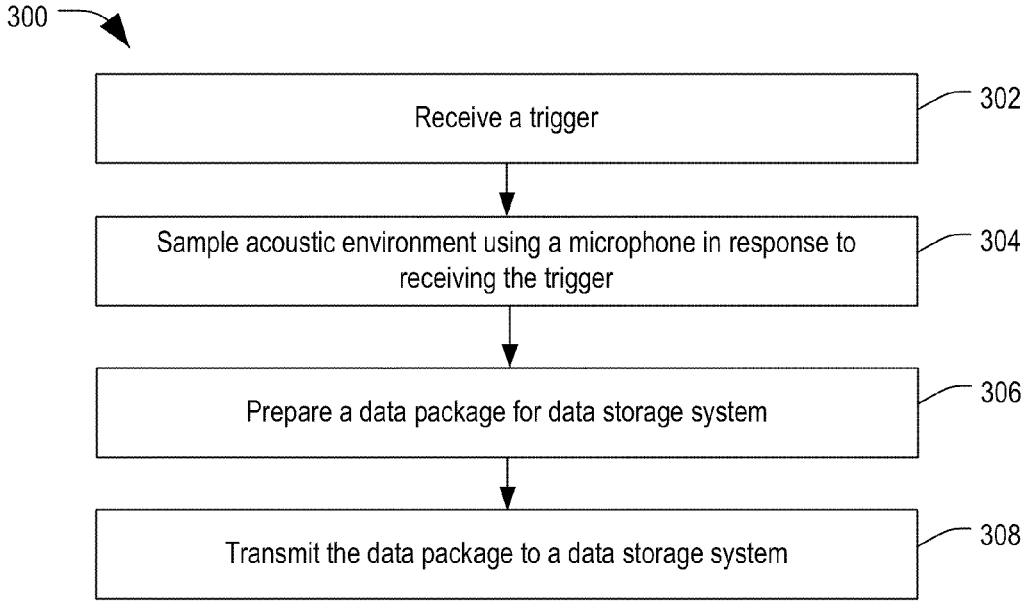
FIG. 3 is a flow diagram of an embodiment of a method of capturing acoustic data associated with an acoustic environment.

FIG. 3 is a flow diagram of an embodiment of a method 300 of capturing acoustic data associated with an acoustic environment, using a system such as the system 100 depicted in FIG. 1. At 302, computing device 122 receives a trigger. A trigger may be user initiated, generated in response to a sound sample taken by either microphone 112 in hearing aid 102 by microphone 136 in computing device 122, or from some other source, such as data storage system 142. In an example, processor 110 within hearing aid 102 detects an acoustic parameter associated with an acoustic signal. When the acoustic parameter exceeds a threshold, processor 110 generates a trigger and provides it to computing device 122.

Once the trigger is received, the method proceeds to 304 and the acoustic environment is sampled using a microphone (either microphone 112 or microphone 136) in response to receiving the trigger. The location of the computing device 122 or hearing aid 102 may optionally be determined. In some instances, such a determination may be based on GPS data. In other instances, the location may be determined through other means, which may be automatic or'determined from user input.

Advancing to 306, processor 132 prepares a data package including data related to the acoustic sample and optionally data associated with the location. In an embodiment, hearing aid 102 provides data related to the acoustic sample to computing device 122. In some instances, the data package may include an audio sample. In other instances, the data package may include data derived from the audio sample. In a particular example, processor 132 collects location data from GPS 126 and sends it and the data package to data storage system 142. In another example, processor 132 packages both acoustic data and location data together for transmission to data storage system 142. In addition, processor 132 may also include date/time data, the currently selected hearing aid profile and/or an identifier thereof, the user's hearing profile and/or data related to the user's hearing profile, and/or other data with the acoustic and/or location data to complete the data package. Proceeding to 308, processor 132 transmits the data package to data storage system 142.

In an alternative embodiment, the method of FIG. 3 can be performed by hearing aid 102. In such an embodiment, processor 110 receives the trigger and either provides the samples to computing device 122 or generates the data package for transmission to computing device 122 and/or to data storage system 142.

Figure 4:
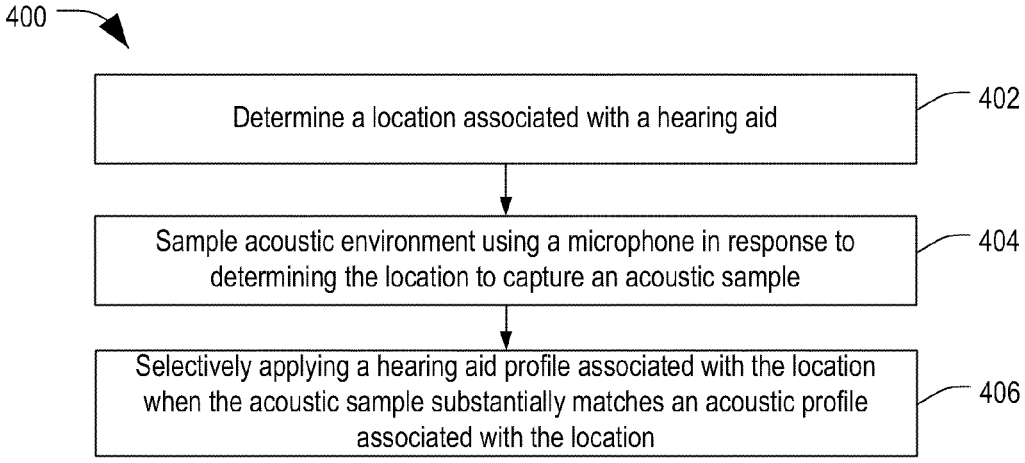
FIG. 4 is a flow diagram of an embodiment of a method of selectively applying a hearing aid profile based on a location of the hearing aid.

FIG. 4 is a flow diagram of an embodiment of a method 400 of selectively applying a hearing aid profile based on a location of the hearing aid. At 402, a location of the hearing aid is determined. In one example, GPS circuitry 127 within hearing aid 102 detects the location and provides location data to processor 110. In another example, computing device 122 provides location data from GPS circuit 126 to hearing aid 102 through the communication channel.

Advancing to 404, the hearing aid 102 or computing device 122 samples the acoustic environment using a microphone in response to determining the location, to capture an acoustic sample. In an example, hearing aid 102 determines a change in a location of the hearing aid based on the GPS data and samples the acoustic environment. In another example, hearing aid 102 may communicate the GPS data to computing device 122 which uses its microphone 136 to capture the acoustic sample. In another example, computing device 122 detects a change in location and controls microphone 136 to capture the acoustic sample or transmits a trigger to hearing aid 102 to cause hearing aid 102 to capture the acoustic sample.

Continuing to 406, processor 110 selectively applies a hearing aid profile associated with the location to produce modulated audio output signals when the acoustic sample substantially matches an acoustic profile associated with the location. In an example, an audio sample can be compressed to form a representative sample to which the acoustic sample can be compared to verify whether the associated hearing aid profile is appropriate for the acoustic environment of the particular location before applying the hearing aid profile. If the acoustic sample does not match the sound sample of the particular location, processor 110 may execute profile selection logic 119 to select an appropriate hearing aid profile based on a substantial correspondence between the sound sample and the compressed sample associated with the appropriate hearing aid profile.

In another example, selective application of the hearing aid profile associated with the location includes application of an appropriate environmental filter. In particular, the acoustic conditions at a particular location may vary over time, and it may be desirable to apply one or more environmental filters to the hearing aid profile (and/or to the modulated output produced by applying the hearing aid profile) to filter various sounds from the audio signal.

While the above-example relates to a method of selecting a hearing aid profile based on location data, it may be desirable to select one or more environmental filters for adjusting a hearing aid profile based on environmental data and/or based on location data. Further, in some instances, it may be desirable to process the acoustic data using a processor that is not associated with the hearing id in order to determine an appropriate hearing aid profile and/or filter. One possible example of a method of providing acoustic data to another device for such processing is described below with respect to FIG. 5.

Figure 5:
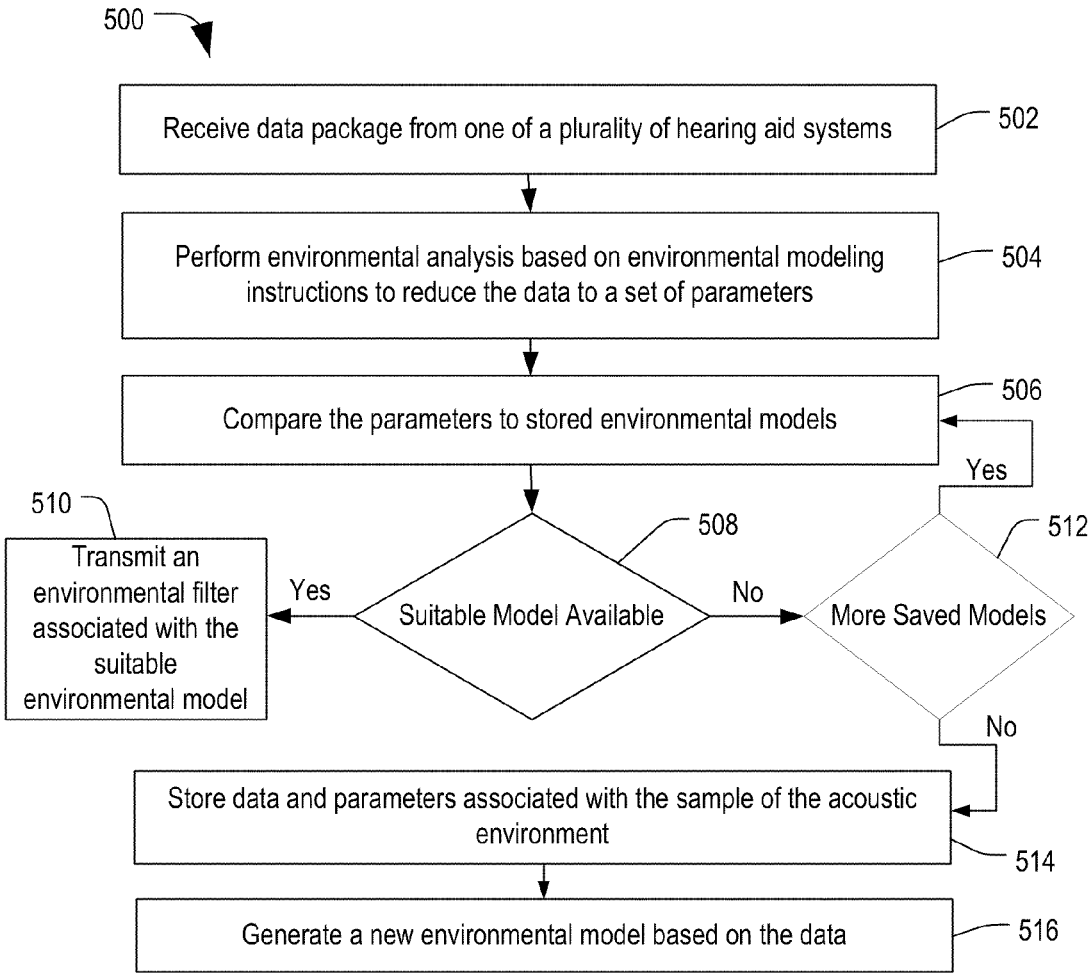
FIG. 5 is a flow diagram of an embodiment of a method of processing a data package from one of a plurality of hearing aids or computing devices to produce an environment-based filter.

FIG. 5 is a flow diagram of an embodiment of a method 500 of processing a data package from one of a plurality of hearing aids or computing devices, such as the hearing aid system 100 in FIG. 1. At 502, a data package representative of the acoustic environment is received from one or more hearing aids and/or computing devices. The data package may include a sound sample, data related to a hearing aid profile, location data, a date/time stamp, and other data.

Proceeding to 504, processor 146 of data storage system 142 analyzes the data package (and its content) using environmental model instructions 154 to produce a set of parameters. In an example, the parameters include acoustic data (sound samples, frequencies, amplitude ranges at given frequencies, or other acoustic characteristics), location data (GPS data and height data), and date/time data. Advancing to 506, the set of parameters are compared to stored parameters of stored environmental models 152 to determine a suitable match.

Advancing to 508, if a suitable environmental model is available, the method 500 proceeds to 510, and data storage system 142 transmits an environmental filter associated with the suitable environmental model to computing device 122 and/or hearing aid 102. In an alternative embodiment, processor 146 may transmit the selected environmental model in place of or in addition to the environmental filters to computing device 122, which may use the environmental model 152 to generate an associated environmental, filter 153.

At 508, if no suitable environmental model is available, the method 500 proceeds to 512 and processor 146 checks memory 148 to see if there are any more environmental models 152 that have not been compared to the parameters. If, at 512, there are more environmental models 152 to analyze, processor 146 selects one and the method returns to 506. If, at 512, there are no more environmental models 152 to compare, the method 500 advances to 514 and the data and parameters associated with the sample of the acoustic environment are stored. Moving to 516, processor 146 generates a new environmental model based on the data. It should be understood that processor 146 may perform the comparison and analysis of the parameters to more than one environmental model at the same time or perform a series of processes to narrow down the possible suitable matches before performing blocks 506 and 508.

In general, the illustrated method 500 represents one possible example of a method of identifying environmental filters associated with an existing mode and/or generating a new environmental model. However, it should be appreciated that, in some instances, blocks may be replaced or omitted and other blocks added without departing from the scope of the disclosure. For example, rather than looking for a suitable model, processor 146 may attempt to match parameters from the data package to corresponding parameters associated with one or more of the environmental filters 153. Further, processor 146 may process the new environmental model 152 to produce an associated environmental filter 153. In particular, processor 146 may identify one or more parameters of the environmental model 152 that exceed one or more thresholds and may generate attenuating filters, notches, or other adjustments for filtering the sound signal, which can be stored as an environmental filter 153.

Figure 6:
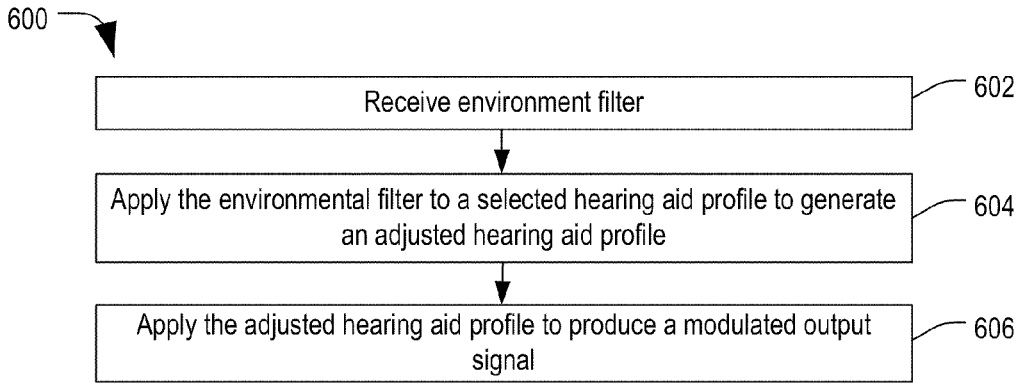
FIG. 6 is a flow diagram of an embodiment of a method of applying an environment-based filter.

FIGS. 3 and 5 demonstrate methods of collecting environmental data and of producing environmental models from such data. FIG. 6 demonstrates one possible method of applying the environmental model to a selected hearing aid profile of hearing aid 102.

FIG. 6 is a flow diagram of an embodiment of a method 600 of applying an environment-based filter. At 602, an environmental filter is received from data storage system 142. The environmental filter may be received by hearing aid 102 or computing device 122, depending on the embodiment. Advancing to 604, the environmental filter is applied to a selected hearing aid profile to generate an adjusted hearing aid profile, which may be suitable to the user's current environment. In an embodiment, computing device 122 receives the environmental filter and processor 132 applies the environmental filter to the hearing aid profile. In an alternative embodiment, processor 132 receives an environmental model from data storage system 142 and applies the environmental model to the selected hearing aid profile to generate the adjusted hearing aid profile. The adjusted hearing aid profile can combine correction for the user's hearing loss with the environmental filter to provide a better hearing experience for the user based on the user's environment. Once the hearing aid profile is generated, computing device 122 communicates the hearing aid profile to hearing aid 102.

Advancing to 606, processor 110 in hearing aid 102 receives and applies the adjusted hearing aid profile. When applying the adjusted hearing aid profile, processor 110 utilizes the profile to shape the sound collected by microphone 112 to generate a modulated output signal that is reproduced for the user by speaker 114.

In an alternative embodiment, computing device 122 may be omitted. In such an embodiment, hearing aid 102 includes a transceiver configured to communicate with network 120 and receives the environmental model (and/or filters) from data storage system 142. Processor 110 performs the function of processor 132 and generates the adjusted hearing aid profile. In this instance, processor 110 utilizes the adjusted hearing aid profile to shape the sound collected by microphone 112 to generate a modulated output signal that is reproduced for the user by speaker 114.

Figure 7:
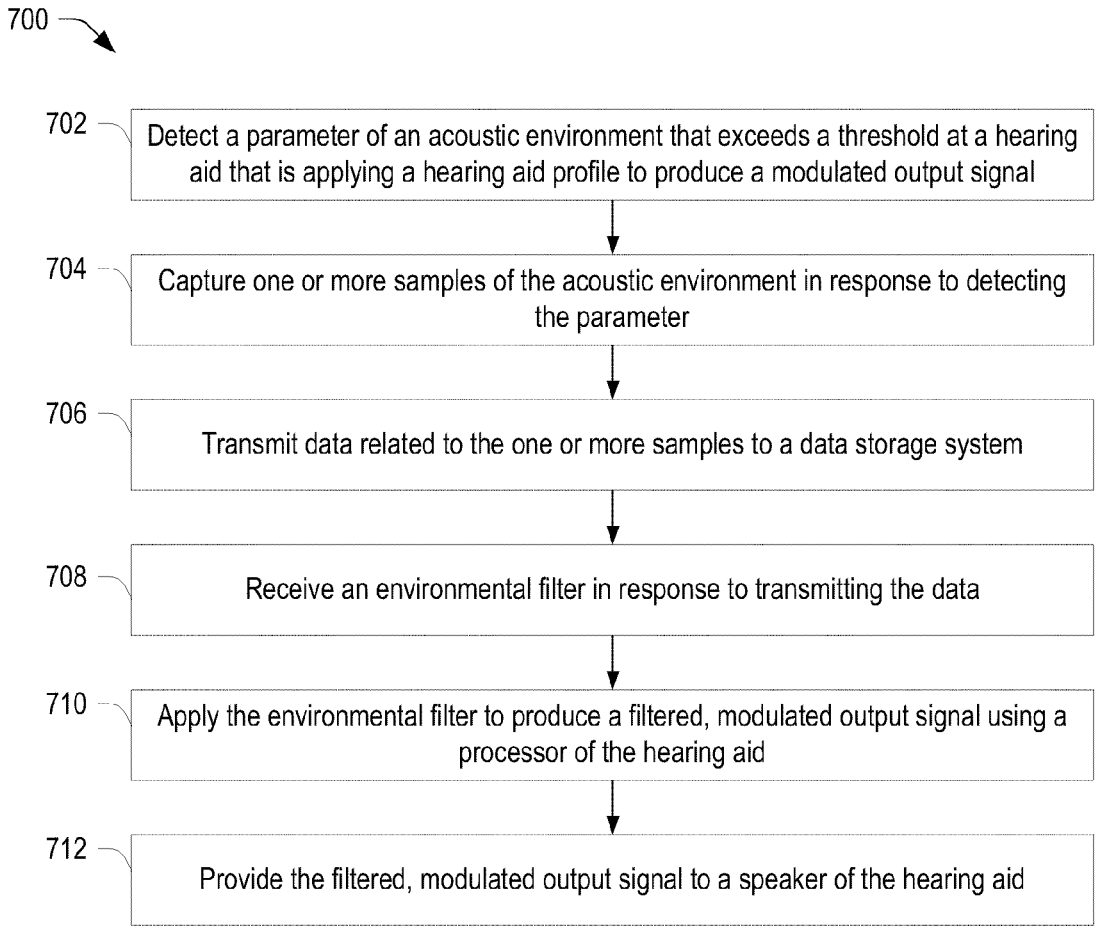
FIG. 7 is a flow diagram of a second embodiment of a method of applying an environment-based filter.

FIG. 7 is a flow diagram of a second embodiment of a method 700 of applying an environment-based filter. At 702, a parameter of an acoustic environment is detected that exceeds a threshold at a hearing aid that is applying a hearing aid profile to produce a modulated output signal. In an example, the parameter can be an amplitude of the modulated output signal at one or more frequencies that exceeds a corresponding threshold.

Advancing to 704, the hearing aid captures one or more samples of the acoustic environment in response to detecting the parameter. The samples may be captured by the microphone of the hearing aid or by a microphone of an associated computing device. Continuing to 706, data related to one or more samples are transmitted to the data storage system. In some instances, the data are transmitted directly from the hearing aid to the data storage system. In other instances, the data are transmitted to a computing device, which provides the data to the data storage system.

Proceeding to 708, an environmental filter is received in response to transmitting the data. In one example, data storage system transmits the environmental filter to hearing aid directly. In another instance, data storage system 142 transmits the environmental filter (or an environmental model) to an associated computing device, such as computing device 122, which transmits the environmental filter to the hearing aid. In the instance where data storage system 142 transmits the environmental model to computing device 122, computing device 122 can retrieve or generate the associated environmental filter and provides the environmental filter to the hearing aid.

Advancing to 710, the environmental filter is applied to produce a filtered, modulated output signal using a processor of the hearing aid. The environmental filter can be applied to a hearing aid profile to produce an adjusted hearing aid profile, which can be applied to a sound signal to produce the filtered, modulated output signal using a processor of the hearing aid. Alternatively, the environmental filter can be applied to a modulated output signal produced by applying a selected hearing aid profile to a sound signal to produce the filtered, modulated output signal. In another embodiment, the environmental filter can be applied to the sound signal prior to application of the hearing aid profile to shape the output signal. Continuing to 712, the filtered, modulated output signal is provided to a speaker of the hearing aid.

In an alternative embodiment, in block 706, the data is transmitted to computing device 122, which has one or more stored environmental filters and which identifies a suitable filter and provides it to the hearing aid in response to the data. In still another embodiment, computing device 122 can generate one or more environmental filters as needed.

Figure 8:
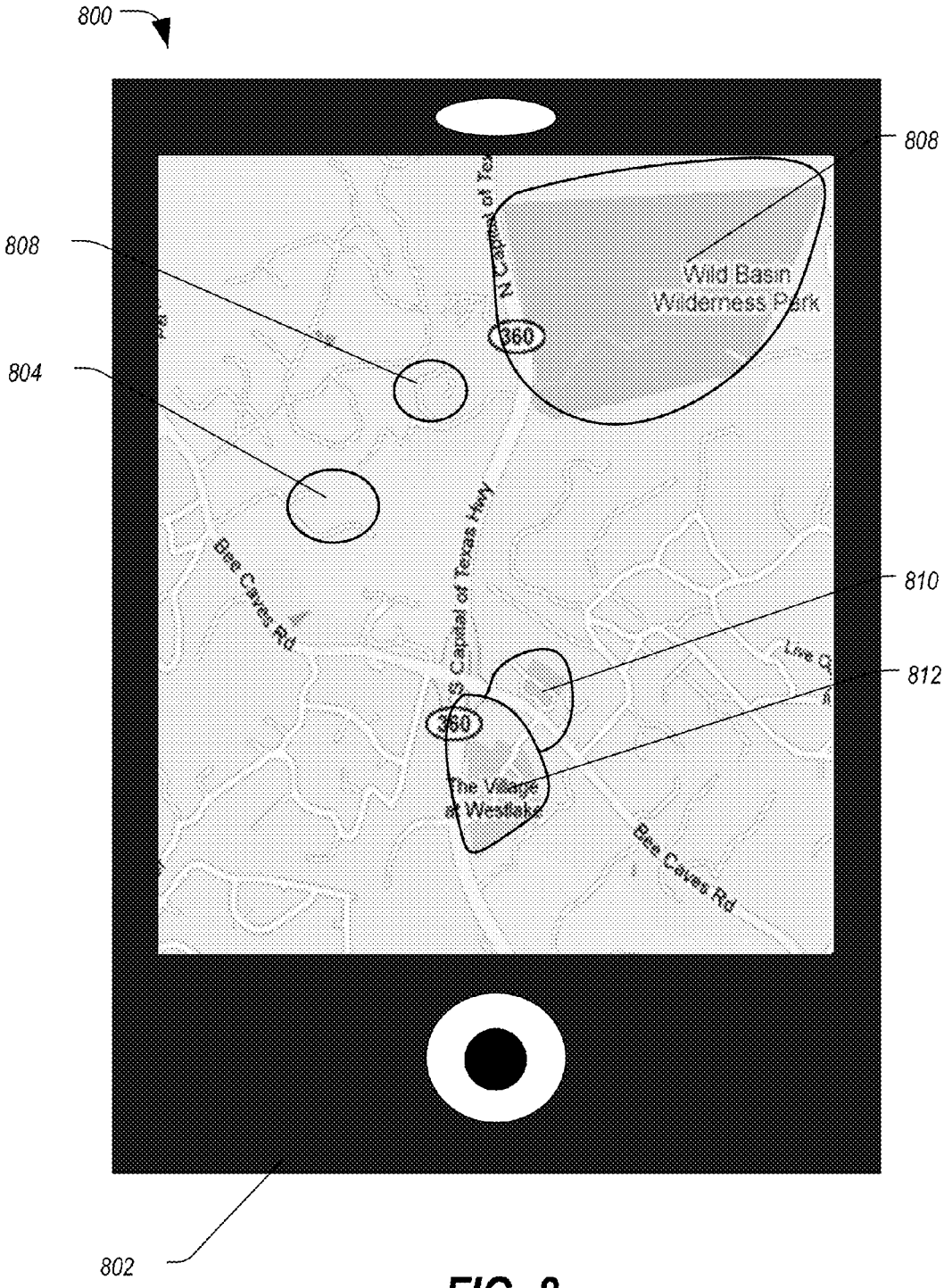
FIG. 8 is a diagram of a representative embodiment of a user interface for configuring a system, such as the system depicted in FIG. 1, to provide location based hearing aid profile selection.

FIG. 8 is a diagram of a representative embodiment of a user interface of the location based hearing aid profile selection system 800. The system 800 includes a computing device, such as computing device 122, which, in this example, is a mobile communication device that includes a touch screen interface that includes both the input interface 128 and the display interface 130. The touch screen interface depicts a map of a particular area with which the user may interact to define geographic areas or regions and to associate each defined geographic area with a respective one of the plurality of hearing aid profiles 166.

In a particular example, the user interacts with the touch screen interface (input interface 128 and display interface 130) to draw boundaries to define geographic areas such as geographic areas 804, 806, 808, 810, and 812. For example, the user could use his/her finger to draw geographic areas on the touch screen interface or double click on a region of the map to generate the geographic area. As each geographic area is drawn, processor 132 executing GUI instructions 160, aid generator instructions 164 and/or profile selection logic 168 may prompt the user to select a hearing aid profile from hearing aid profiles 166 to associate with the particular geographic area. In some instances, processor 132 may associate the currently selected hearing aid in lieu of a user selection. Once a hearing aid profile is associated with the geographic area, it may be activated whenever the user enters the geographic area. For example, upon determining that the hearing aid 102 has entered the particular geographic area, processor 110 automatically applies the associated hearing aid profile, which may be communicated to hearing aid 102 by computing device 122. In another example, hearing aid 102 or computing device 122 may notify the user that he/she has entered the geographic area, and computing device 122 may prompt the user to select whether to apply the associated hearing aid profile. Further, the same interface may be used to change such hearing aid profile associations, such as when an acoustic profile of a particular geographic area changes.

In another particular example, the user may interact with the input interface 128 to enter in a series of GPS coordinates (such as to move around and lock in the coordinates at various perimeter locations) in order to define a boundary which processor 132 may then use to extrapolate geographic areas and to display the geographic areas as areas 804, 806, 808, and 812 on display interface 130.

In the illustrated embodiment, some areas geographic areas may be continuous, such as geographic areas 814 and 810. Other geographic areas may be separated and distinct, such as geographic areas 804, 806, and 808. Additionally, over time, an acoustic profile may be established for the particular region, allowing the hearing aid profile to change seamlessly as the user moves from one area to another. In some instances, the geographic areas may overlap. In a particular example, geographic areas may include altitude information such that acoustic information for one floor of a skyscraper may differ from that of another floor, and hearing aid 102 may apply an appropriate hearing aid profile and/or environmental filter for the particular location.

In another particular example, such boundaries may be defined automatically by processor 132 based on implicit user actions and explicit user feedback. For example, as the user moves around within a particular area using a selected hearing aid profile, the location data associated with the hearing aid and its associated hearing aid profile may be monitored. A boundary may be traced around the region within which the user continued to utilize a given hearing aid profile. Upon user-selection of a new hearing aid profile, the location information can be used to place or define a boundary indicating a new acoustic region within which the new hearing aid profile should be applied. In this example, the map may depict already produced geographic areas, which the user may select to view associated information and/or to modify settings as desired.

Figure 9:
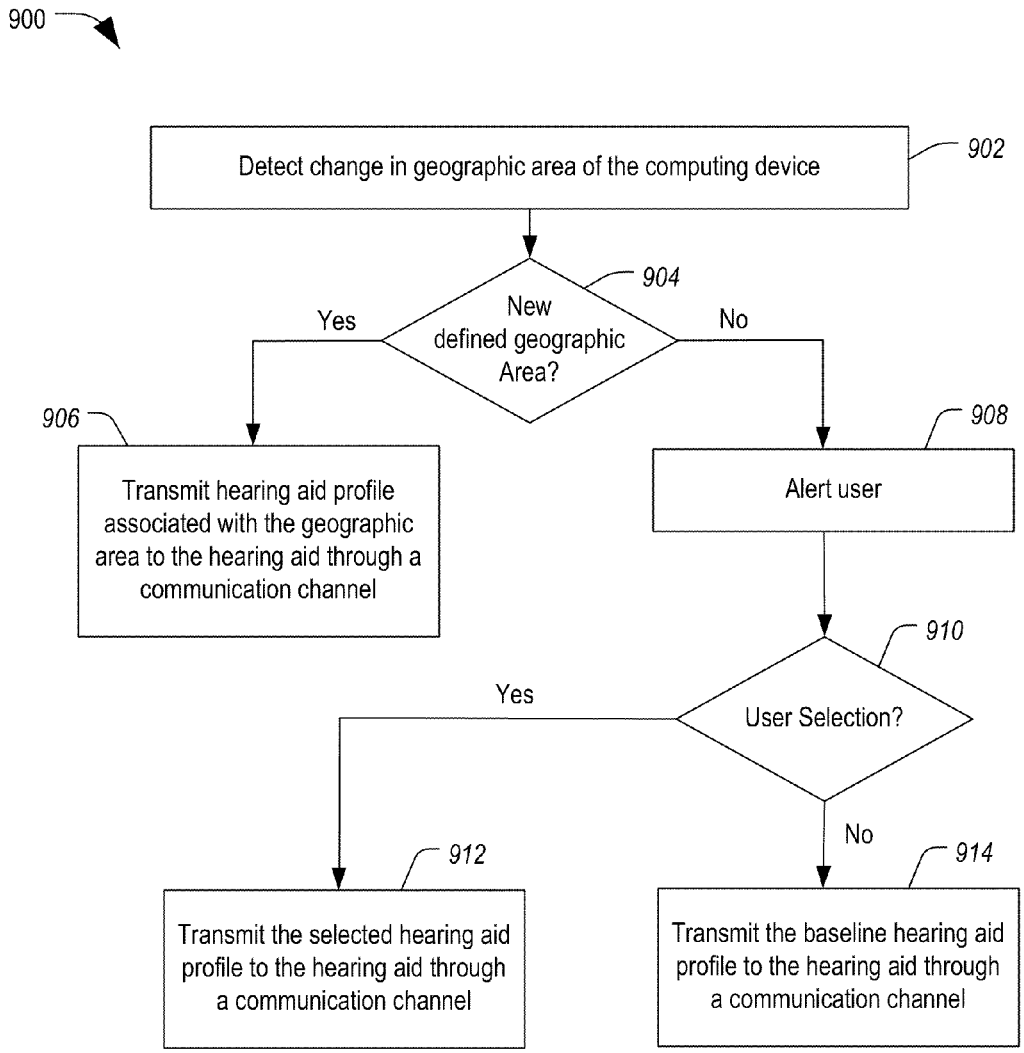
FIG. 9 is a flow diagram of an embodiment of a method of providing location based hearing aid profile selection.

FIG. 9 is a flow diagram of a method 900 of providing location-based hearing aid profile selection. At 902, a change is detected in the geographic area of computing device 122. The change may be detected based on a user input or based on data from the location indicator 138. Advancing to 904, processor 132 in computing device 122 will determine if the user has entered a new defined geographic area. If the user has entered a new geographic area defined in a plurality of geographic areas stored in memory 124 of computing device 122, then the method 900 advances to 906 and a hearing aid profile associated with the geographic area is transmitted to hearing aid 102 through the communication channel.

If, at 904, the user has entered a new geographic area that is not defined within the plurality of geographic areas, then the method 900 advances to 908. At 908, processor 132 will alert the user. In a particular example, the processor 132 may provide an audible alert, a visual alert, a signal that can be used to generate an audible alert within the hearing aid 102, or any combination thereof. The alert may indicate that the user has entered a geographic area that does not have an associated hearing aid profile. The alert may also include presentation of a graphical user interface including user-selectable elements to allow a user to select a new hearing aid profile or to keep the currently selected hearing aid profile. Proceeding to 910, if the user selects a new hearing aid profile, then method 900 proceeds to 912, and the selected hearing aid profile is transmitted to hearing aid 102 through the communication channel. Otherwise, if the user does not make a selection at 910, the method advances to 914 and a baseline hearing aid profile is transmitted to hearing aid 102 through the communication channel.

In an alternative embodiment, at 910, a user may elect to keep the currently selected hearing aid profile. In this instance, processor 132 may monitor the user's location until the user elects to change the hearing aid profile, and then extend the boundary of the defined geographic area accordingly. However, if the user is driving in his/her vehicle, the user may not need to change his/her hearing aid profile, but a change in the geographic area may not be desirable. Accordingly, the automatic update may be based on the user's activity and a rate of change in the user's location. A rate of change that is greater than 10 miles per hour, for example, may be treated as vehicle travel as opposed to hiking, and the boundary may be left unchanged. In another instance, processor 132 may track the changes to the user's location and, when the user elects to change the hearing aid profile, processor 132 may provide an option for the user to authorize extension of the boundary of the geographic area using a graphical user interface displayed on the touch screen, for example.

Method 900 describes one abut many possible methods of defining a geographic area using computing device 122 or hearing aid 102. It should also be understood that the order in which the steps of method 900 are preformed may vary in other possible embodiments. Additionally, although method 900 is discussed with respect to computing device 122, it could be preformed within hearing aid 102, by a server configured to communicate with hearing aid 102, or through an intervening computing device.

Figure 10:
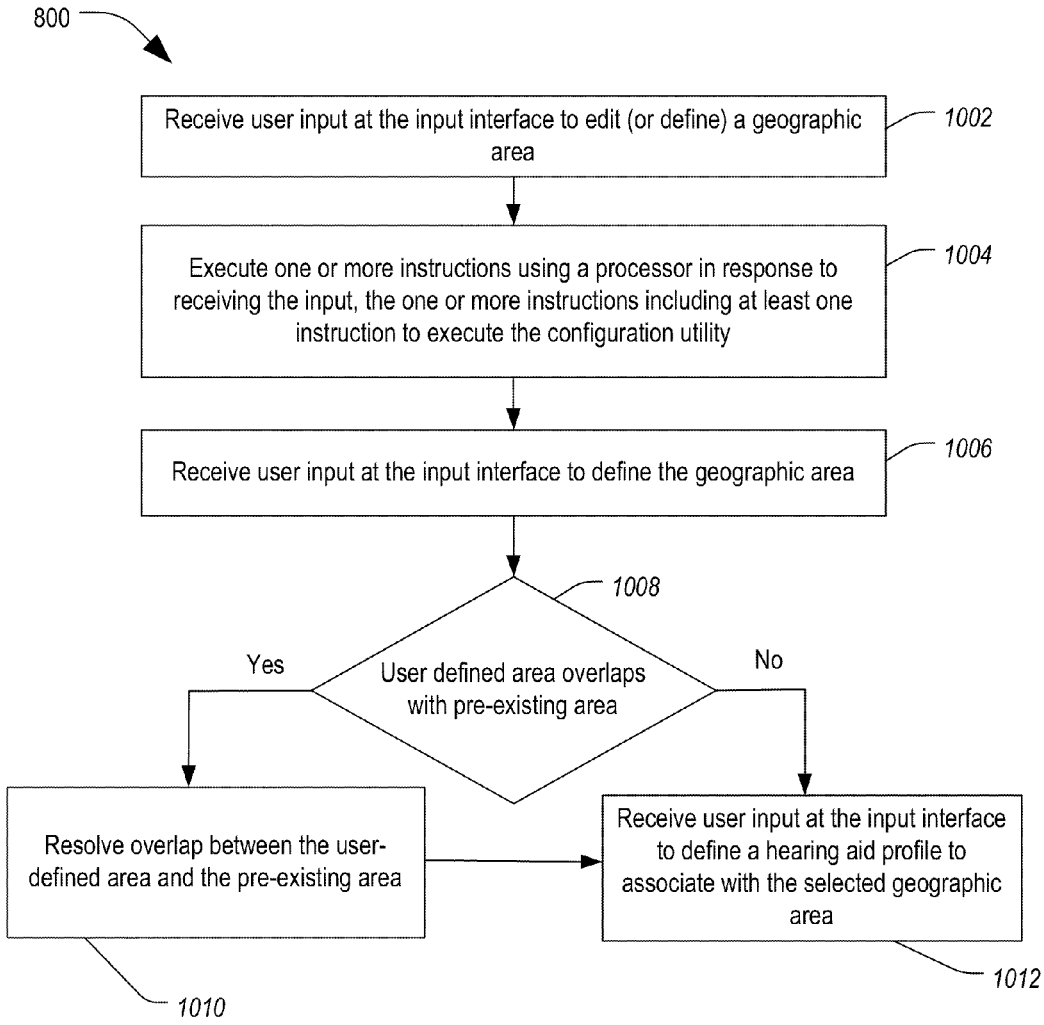
FIG. 10 is a flow diagram of an embodiment of a method of associating hearing aid profiles with geographic areas for a location based hearing aid profile selection system, such as the system depicted in FIG. 1.

FIG. 10 is a flow diagram of a method 1000 for defining geographic areas for the location based hearing aid profile selection system. At 1002, user input is received at input interface 128 to edit (or define) a geographic area. Proceeding to 1004, processor 132 executes one or more instructions, including at least one instruction to execute GUI instructions 160, in response to receiving the input. Processor 132 executes GUI instructions 160 to produce a GUI that includes user-selectable elements with which the user can interact to edit and define geographic areas, hearing aid profile generator instructions 164 to edit and/or create hearing aid profiles, and profile selection logic 168, which allows the user to associate a hearing aid profile with a geographic area. Further, hear aid profile generator instructions 164 can be executed by processor 132 to allow a user to select and tailor a hearing aid profile for a selected geographic area using input interface 128.

Advancing to 1006, processor 132 receives user input from input interface 128 that defines a geographic area. For example, the user may define a geographic area as discussed with respect to FIG. 8 using a map displayed on display interface 130 within the GUI.

Continuing to 1008, if the user-defined area overlaps with a pre-existing area, the method 1000 proceeds to 1010 and the overlap between the user-defined area and the pre-existing area is resolved. In an example, processor 132 may resolve the overlap by preferring the pre-existing geographic area and by adjusting the user-defined area to abut the pre-existing geographic area. In another example, processor 132 may resolve the overlap by preferring the newly defined area by adjusting the pre-existing geographic area to abut the user-defined area. In another example, processor 132 may present the overlap to the user through the GUI, indicating the conflict between the areas and requesting user feedback to resolve the overlap.

At 1008, of the user-defined area does not overlap with the pre-existing area or if the overlap is resolved (at 1010), the method 1000 continues to 1012 and user input is received at input interface 128 to define a hearing aid profile associated with the selected geographic area. For example, the user may select a pre-existing profile from the plurality of hearing aid profiles 166, generate a new hearing aid profile, or adjust a selected one of the hearing aid profiles 166 and associate the selected profile to associate with the geographic area. Processor 132 also stores the geographic area information and the associated hearing aid profile in memory.

Method 900 describes one of but many possible methods of applying a geographic area using computing device 122 to hearing aid 102. It should also be understood that the order in which the steps of method 900 are preformed may vary in other possible embodiments. Additionally, although method 900 is discussed with respect to computing device 122, it could be preformed within hearing aid 102, by a server configured to communicate with hearing aid 102, or through an intervening computing device.

In conjunction with the systems, the hearing aid, and the methods described above with respect to FIGS. 1-10, a system is disclosed that collects acoustic data from a variety of sources and that produces environmental models from the acoustic data. The environmental models may be location-specific (i.e., associated with a particular location) and/or specific to one or more acoustic parameters. The environmental models can be used to produce sound filters for attenuating, filtering, or otherwise dampening environmental noise associated with a particular acoustic environment. The sound filters can be provided to a computing device and/or a user's hearing aid (upon request or automatically) for application to one of a selected hearing aid profile and a modulated output signal to produce a filtered, modulated output signal configured to enhance the user's hearing experience in a particular acoustic environment.

By collecting environmental samples from a variety of sources, an acoustic profile (environmental model) of a location may be developed over time, and sound filters may be generated and refined for the location. Such environmental models can incorporate data from the various sources to improve the accuracy of the environmental model, allowing for refinement of the sound filters over time. The collected data can be used to produce a plurality of pre-defined environmental models and associated sound filters, which can be made accessible to a plurality of users for enhancing their listening experience. By providing the user with pre-programmed environmental models automatically customizable by the hearing aid system based on the user's hearing profile, the hearing aid is adjustable to provide a better hearing experience while reducing the amount of time the user has to spend at the audiologist's office or self-programming the hearing aid. Further, by producing sound filters for particular locations that are independent of the hearing aid profiles of the various users, the sound filters can be applied to hearing aids having different hearing aid profiles without having to customize the sound filters for each hearing aid and for each user. Thus, the sound filters can be used to attenuate undesired environmental noise for different users at different times and having different hearing impairments.

Further, the system includes location detection circuitry, such as a GPS circuit, for determining a location of hearing aid 102 and/or computing device 122. A hearing aid profile for application by hearing aid 102 may be selected based on the location. Further, a user interface is disclosed that can be presented on computing device 122 to allow a user to configure a geographic area and to associate a hearing aid profile with the geographic area.

Although the present invention has been described with reference to preferred embodiments, workers skilled in the art will recognize that changes may be made in form and detail without departing from the scope of the invention.

What is claimed is:

1. A method comprising:

receiving location data related to an acoustic environment at a data storage system;

selecting an environmental model from a plurality of environmental models based on the location data, the selected environmental model having an associated environmental filter, the associated environmental filter configured to be applied in addition to a hearing aid profile by a hearing and to compensate for specific sound characteristics associated with the selected environmental model; and providing the associated environmental filter to at least one hearing aid.

2. The method of claim 1, wherein:

each of the plurality of environmental models includes a location indicator; and the selected environmental model is identified by comparing the location indicator to the location data.

3. The method of claim 2, wherein:

both the location data and the location indicators includes longitude, latitude, and altitude data.

4. The method of claim 2, wherein:

the location data includes time data;

the plurality of environmental models include multiple environmental models for a single location, the multiple environmental models varying according to time; and the selected environmental model has a time that corresponds to the time data and a location that corresponds to the location data.

5. The method of claim 1, wherein the suitable environmental model includes acoustic data related to a particular acoustic environment associated with the computing device.

* * * * *